US005871111A

United States Patent [19]

Pfefferkorn et al.

[11] Patent Number: 5,871,111

[45] **Date of Patent: *Feb. 16, 1999**

[54] SCREWABLE CLOSURE CAP WITH SECURITY AGAINST OVER-TIGHTENING

[75] Inventors: Georg Pfefferkorn; Michael Kirchgessner, both of Egringen, Germany

[73] Assignee: Crown Cork AG, Reinach, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 530,237

[22] PCT Filed: Jan. 26, 1995

[86] PCT No.: PCT/CH95/00017

§ 371 Date: May 15, 1996

§ 102(e) Date: May 15, 1996

[87] PCT Pub. No.: WO95/21095

PCT Pub. Date: Aug. 10, 1995

[30] Foreign Application Priority Data

Feb. 1, 1994 [CH] Switzerland ..... 289/94

[51] Int. Cl.[6] ..... B65D 41/04; B65D 51/16

[52] U.S. Cl. ..... 215/307; 215/329; 215/331; 215/341; 215/344; 215/345; 215/354; 215/902

[58] Field of Search ..... 215/330, 331, 215/270, 271, 307, 339, 338, 343, 329, 344, 345, 341, 354, 321, DIG. 1, 902, 311, 313, 314, 316; 220/231, 288, 303, 366.1, 360

[56] References Cited

U.S. PATENT DOCUMENTS

| | | | |
|---|---|---|---|
| 3,463,340 | 8/1969 | Lindstrom | 215/330 |
| 4,193,509 | 3/1980 | Dunn, Jr. et al. | 215/330 |
| 4,276,989 | 7/1981 | Hicks | 215/270 |
| 4,289,248 | 9/1981 | Lynn | 215/331 X |
| 4,640,430 | 2/1987 | Haines | 215/330 |
| 4,697,715 | 10/1987 | Beruvides | 215/330 |
| 5,133,471 | 7/1992 | Pujol Almirall | 215/221 |
| 5,292,020 | 3/1994 | Narin | 215/330 |

FOREIGN PATENT DOCUMENTS

| | | |
|---|---|---|
| 0 568 228 A1 | 11/1993 | European Pat. Off. . |
| 20 35 246 | 1/1972 | Germany . |
| 39 05017 A1 | 8/1990 | Germany . |
| 9206634 U | 9/1992 | Germany . |
| 9208944 U | 10/1992 | Germany . |
| 2 013 635 | 8/1979 | United Kingdom . |
| WO 90/10581 | 9/1990 | WIPO . |

*Primary Examiner*—Stephen J. Castellano
*Assistant Examiner*—Niki M. Eloshway
*Attorney, Agent, or Firm*—Woodcock Washburn Kurtz Mackiewicz & Norris LLP

[57] ABSTRACT

In the case of over-tightening of the closure-cap on a beverage bottle (through turning in the wrong direction) there is the risk that, due to the high internal pressure, not only will the thread jump, but also that the cap will be ejected directly from the container. In order to avoid this risk, the invention proposes a screwable closure-cap with security against over-tightening. This cap possesses a ramp element (3) on the end of the thread oriented towards the cap-base, said ramp element being able to engage with the thread-start of the container mouth in the case of over-tightening of the closure-cap. As a result, the cap-wall in the area of the ramp element will be forced outwards in the case of over-tightening so that jumping of the thread in this region will be facilitated. In this way, jumping of the thread on one side only—on the ramp element side—will be achieved when over-tightening is continued, so that ejection of the closure-cap will not be possible. In a further embodiment of the invention, retention elements (7,8) are arranged in the region of the seal. As a result of over-tightening and subsequent deformation of the region of the seal, said retention elements will make contact with the container mouth and the sealing-line will be interrupted. As a result, the container will be vented prior to jumping of the thread.

13 Claims, 4 Drawing Sheets

SCREWABLE CLOSURE CAP WITH SECURITY AGAINST OVER-TIGHTENING

Figure 1:
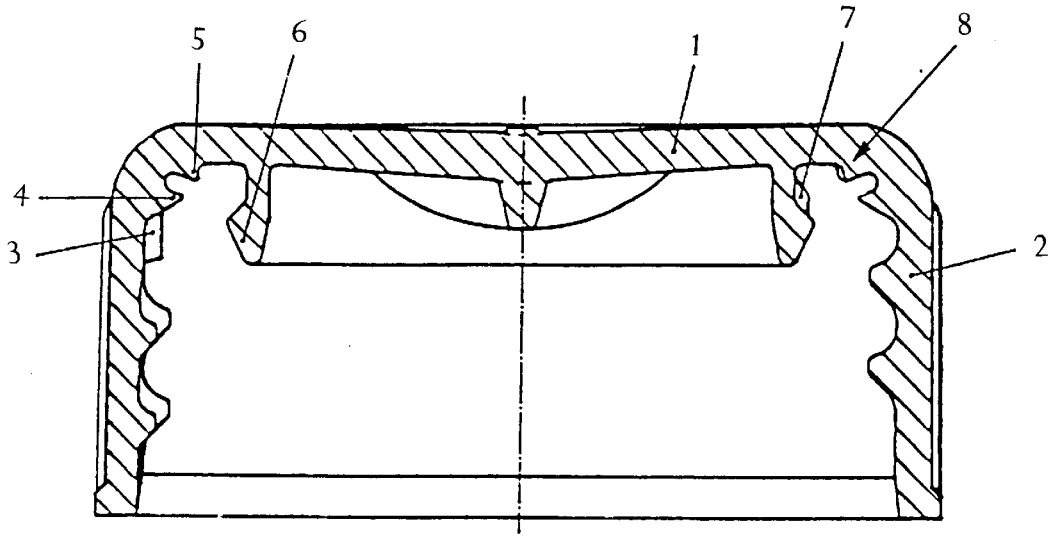

The invention concerns a plastic screw-cap according to the preamble of the independent patent claims. These types of screw-caps are manufacture by the injection molding process in very great quantities, and are used as closures for containers of the most varying types. Plastic screw-caps have become established mainly in the area of refreshment beverages containing carbon dioxide. The closed container can be subjected to extreme pressure in these cases, since the liquid it contains has been treated with carbon dioxide and will release gas.

Closure-caps are already known which are constructed in such a way that, on opening the closure, the container will be vented prior to the closure-cap thread being disengaged from the container. The risk of the closure suddenly being ejected from the container due to the high pressure will thus be lessened.

A problem with known screw-caps is their behaviour in the case of mishandling. If, in order to open it, the closure is accidently rotated in the wrong direction, over-tightening of the thread will result, and with continued over-tightening the closure thread can jump. This behaviour would be inconsequential with non-pressurised containers. After jumping, the closure-cap would re-engage on the container one thread-winding further up. If the container is under pressure, however, which will be the case with beverages containing carbon dioxide, for example, it is possible that the thread will no longer re-engage sufficiently rapidly after jumping, and that the cap will fly at high speed away from the container. In the past, such behaviour during mishandling of the closure has led to accidents.

WO-90/10581 shows a closure-cap possessing a braking element. This element is arranged at the end of inside thread oriented towards the cap-base in such a way that it lies at least partly in the region of the outside thread helix. On completion of the screwing-on procedure, the braking element will therefore run up on the container mouth thread-start, and will remain engaged with this thread-start when the closure-cap is its fully screwed-on position. The brake element fulfils the function of braking the screwing-on motion when the required end-position has been reached. In the case of closure-caps lacking a braking element, this function is assumed by the seals.

It is a purpose of the invention to form the screw-caps of the type mentioned in the introduction in such a way that the risk of sudden ejection of the closure-cap as a result of over-tightening the thread is greatly reduced. According to the invention, this purpose is fulfilled with a screw-cap which possesses the features described in claim 1 or in claim 3.

A ramp element is located on the end of the inside thread oriented towards the cap-base. With that, the ramp element must not lie in the area of the thread-turns, but can be located outside of the thread area, in line with the threadend. The ramp element lies outside that area of the thread which is used when the screw-cap is in the screwed on position. It is arranged in such a way that it can be brought into engagement with the container mouth thread-start as a result of over-tightening of the closure-cap. The term "brought into engagement" means that the ramp element runs up onto the container mouth thread-start. The ramp element is thus located at least partly in line with the anticipated continuation of the helix for the outside thread, so that in the case of over-tightening of the closure-cap, it will come into the region of the thread-start, and will run up on said thread-start.

The risk of the cap being suddenly ejected by over-tightening is clearly lessened by this ramp element. The cap-wall in the region of this ramp element will be forced outwards due to the ramp element running up on the thread-start. This will result in thread jumping being facilitated on this side since, due to the cap-wall being pressed outwards, it will no longer be fully engaged. Exactly the opposite will occur on the side of the closure-cap opposite to the ramp segment: since the cap-wall is pressed outwards on the ramp element side, at this opposite point it will be pressed against the container neck with a corresponding increase in force, and jumping of the thread will thus be hindered. With continued over-tightening, jumping of the thread can indeed not be prevented, although a simultaneous jumping of the thread around the entire circumference will be prevented. Thread-jumping will occur first of all on the ramp element side, and only subsequently, if at all, on the opposing side. After jumping, re-engagement of the thread on the ramp element side will thus be achieved before the thread jumps in a similar way on the opposing side. The risk of complete ejection of the cap during over-tightening of the closure will as a result be greatly reduced.

In the case of over-tightening, the ramp element will cause a deformation of the closure-cap. This deformation can be additionally exploited in order to enable venting of the container prior to jumping of the thread. The closure-cap possesses at least one surrounding seal. This seal lies along a sealing-line at the mouth of the container. The course of the sealing-line is able to be altered by the ramp element during over-tightening of the closure-cap, with the alteration to the course of the sealing-line being a result of the deformation caused by the ramp element. The security of the closure-cap against over-tightening will be further improved if, in the region of the seal, at least one retention element is provided in the region of the seal in order to prevent a seal being formed when the course of the sealing-line has been altered. The ramp element thus indirectly prevents sealing of the container when the closure-cap is over-tightened. As over-tightening increases, the subsequent deformation will likewise increase. In order to reduce the pressure within the container at the correct moment, the deformation necessary for opening the seal must be achieved prior to jumping of the thread.

The actual design of the ramp element exerts an influence on the force applied to cause over-tightening as well as the associated deformation of the closure-cap. A form is preferred where the ramp element extends over a sector of at least 20°, preferably 60° of the closure-cap. The intended deformation will be then attained if the inside radius in the region of the ramp element is only a few tenths of a millimeter less than the outside radius of the container thread.

By increasing the thickness of the ramp element, the attainable deformation can be increased. This thickness is limited by the diameter of the container mouth to be closed; the inside radius in the region of the ramp element must be greater than the outside radius of the container mouth.

In order to fully exploit the container thread, the closure-cap is so designed that, with the closure-cap in the screwed on position, the inside thread-end comes to lie in the region of the outside thread-start. The ramp element is then preferably arranged directly behind the inside thread-end.

The sealing-line is a line along which the closure-cap and container mouth make contact. In order to prevent the formation of a seal, it must be ensured that no further surrounding sealing-line exists. The alteration to the course of the sealing-line can occur in two ways: in the first instance, on the basis of the cap deformation, a sealing-lip can be caused to lift away in a certain region of the container mouth. The second instance is much more frequently encountered, with which the sealing-line is displaced. With that, the point of contact displaces away from the sealing-lip to a region which lies adjacent to the sealing-lip. This new point of contact is now, on the basis of at least one retention element, designed in such a way that the formation of a seal at this point is prevented. Here, basically any type of surface profile can be involved which is suitable to prevent the formation of a seal between the point of contact concerned and the container mouth. Frequently, a retention element is allocated to a specific sealing-lip and arranged in such a way that this sealing-line is interrupted as rapidly as possible in the case of over-tightening. In each case, the retention element will be located within the region of the seal of the closure-cap, i.e. near the seals which are generally arranged on the cap-base and/or in the adjacent region of the cap-wall.

Distance elements and/or venting-slots are preferably used as retention elements. Distance elements mostly take the form of a cam and tend to possess a small contact surface so that a venting-channel of sufficient size will remain open adjacent to the sealing element.

The deformation caused by the ramp element is not limited to the cap-wall, but also effects the cap-base. This will undergo displacement towards the side of the closure-cap oriented away from the ramp element=a most surprising behaviour. Because the cap-wall is pressed outwards on the ramp element side, a displacement of the cap-base would also be expected in this direction. The reason for this behaviour, however, lies in the differential engagement of the thread on each side. The cap-wall will be pressed outwards by the ramp element in this region, and the thread will no longer fully engage at this point. On the opposing side, the opposite is the case: the cap-wall will be forced against the container neck and the thread will be tightly engaged. On the side of the ramp element, the cap-wall will hence displace upwards, and will tend to jump over. Conversely, on the opposing side it will be forced downwards by the tightly engaged thread, by which means the cap-base will also be forced to this side. On the side of the closure-cap opposite the ramp element, a particularly marked alteration to the course of the sealing-line will ensue, so that the retention element is preferably arranged on this side.

A type of seal which is preferably used here is described as a head-seal: a seal which takes effect on the facing surface. This seal extends over the inside surface of the cap-base and, when the container is closed, will lie against the facing surface of the container mouth. The seal must be designed in such a way that the sealing-line is able to be interrupted due to the deformation occurring in the case of over-tightening. In addition, it is easiest if the marked deformation in the region of the seal on the side opposite the ramp element is exploited. The seal is thus designed in such a way that, in the case of over-tightening, the sealing-lip in this region is dragged out over the facing surface of the container mouth. At least one retention element is arranged on the side of the closure-cap opposite the ramp element, adjacent to and on the inner side of the head-seal. As soon as the sealing-lip disengages from the container mouth in the case of over-tightening, said sealing-lip will come to rest against the closure-cap in the region of the retention element, which will prevent formation of a seal for the container. Both a distance element and a venting-slot can be used as a retention element. In order to maintain as large a venting-channel as possible, it must be ensured that the sealing-lip dragged out across the face of the container does not lie on the outer surface of the container mouth. This can be achieved in an especially simple way by using a distance element which is so arranged that the contact force impinging upon it is at least partially radial, taking effect in an outwards direction. The sealing-lip will thus be forced away from the container mouth.

Another frequently used type of seal is the internal-seal. This extends from the inside surface of the cap-base towards the cap-opening and is designed in such a way that, with a closed container, it protrudes into the container opening and can form a seal on its inner surface. In addition, the internal-seal possesses a sealing-zone in which the diameter of the internal-seal is greater than the diameter of the container opening. Also with this example, in the case of over-tightening, displacement of the cap-base occurring as a result of the ramp element will be exploited, in order to interrupt the sealing-line. In principle, this can ensue both on the ramp element side and on the opposing side of the closure-cap. As has already been described, in the case of over-tightening, the cap-base will be forced to the side of the closure-cap oriented away from the ramp element. On the ramp element side, the internal-seal will at the same time be forced away from the inside surface of the container mouth. With sufficient displacement of the cap-base, the seal in this area will be lifted away, and this will lead to an interruption of the sealing-line. In this case, no retention element will be necessary for interruption of the sealing-line. Since the seal is under tension against the container mouth, this will only ensue with marked deformation of the closure-cap.

A more rapid opening if the internal-seal can be achieved on the opposing side of the closure-cap. For this purpose, the outside surface of the internal-seal possesses at least one retention element on the side oriented away from the ramp element, said retention element being arranged on the side of the sealing-zone oriented towards the cap-base. With that, the radius of the internal-seal in the region of the retention element is only slightly smaller than in the region of the sealing-zone, so that the said retention element does not make contact with the container mouth when the closurecap is in place. Through displacement of the cap-base in the case of over-tightening of the closure-cap, the seal in this region will be forced more tightly against the inside wall of the container mouth. Since the seal makes contact with the container mouth in the region of the sealing-zone, it will maintain its position at this point. Conversely, it will not make contact with the container mouth in the region of the cap-base, and this region of the seal will thus be displaced with the cap-base in the direction of the container wall. This restriction of displacement to the cap-base will inevitably lead to an inclination of the internal-seal. With that, the retention element will move closer to the inside surface of the mouth. With sufficient distortion, the internal-seal will make contact with the container mouth in the region of the retention element, and the sealing-zone will thus be lifted away from the container mouth. A knob shaped distance element is preferably used as a retention element in this case. The seal can thus be designed to be considerable thinner, only approximately attaining the radius of the sealing-zone in the region of the distance element. In this way, the necessary freedom of movement will be maintained, also for the inclined position of the seal.

As a rule, with known closure-caps numerous sealing-lips are employed in combination. For example, an internal-seal, a head-seal and an external-seal can be used. Accordingly, a combination of the described embodiments can be employed. The principles described can also be transferred to embodiments of seals which are not portrayed here.

The reliability of the security against over-tightening can be further improved if a plurality of retention elements are arranged to be distributed over a sector of at least 20°. Preferably, the retention elements are arranged to be distributed over a sector of approximately 60° of the closure-cap.

Distribution of the retention elements over a larger sector permits opening of a larger venting channel in the case of over-tightening. Venting of the container will thus be accelerated.

Figure 2:
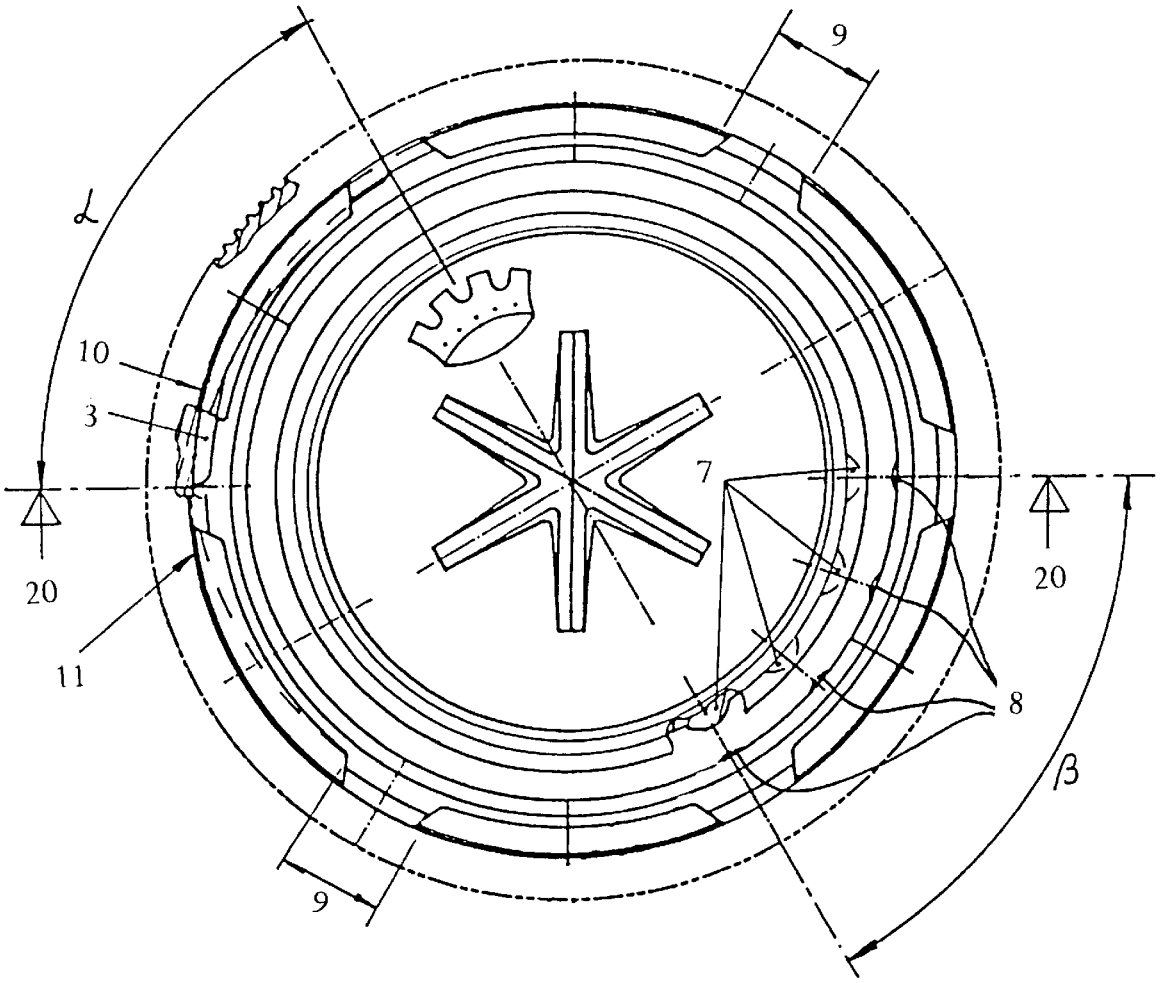
Figure 3:
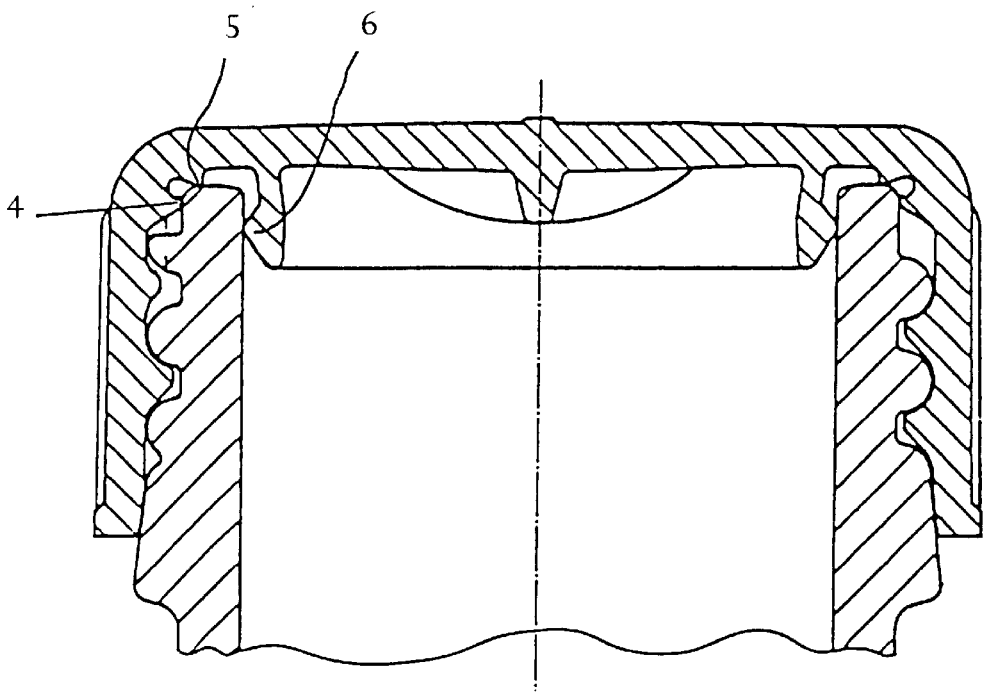
Figure 4:
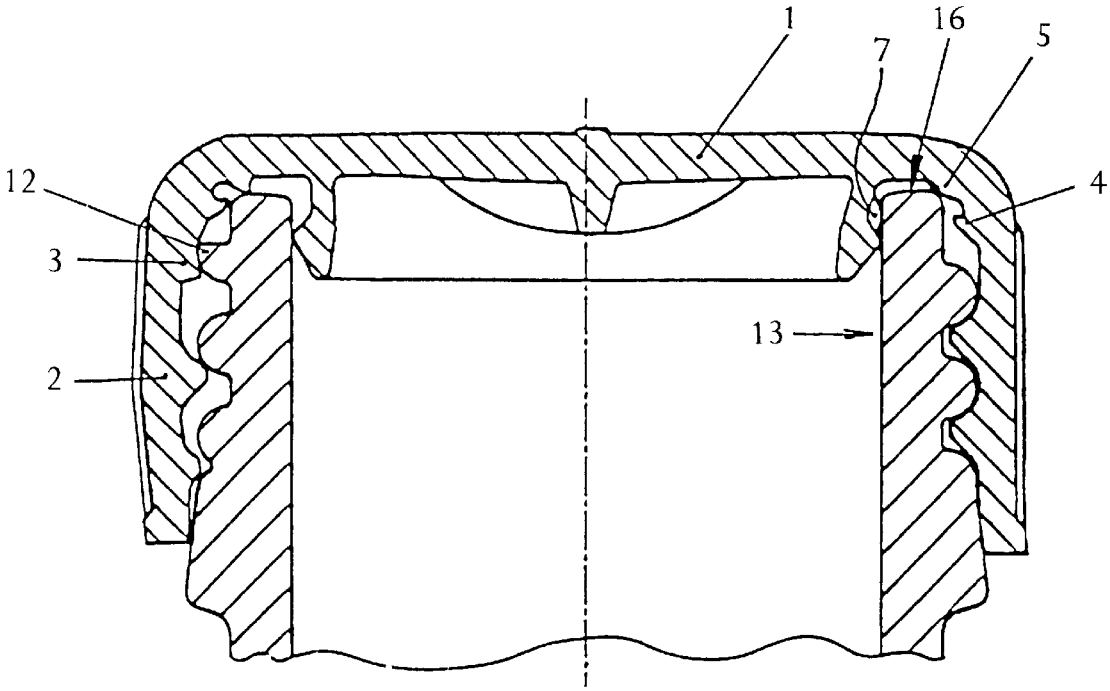
Figure 5:
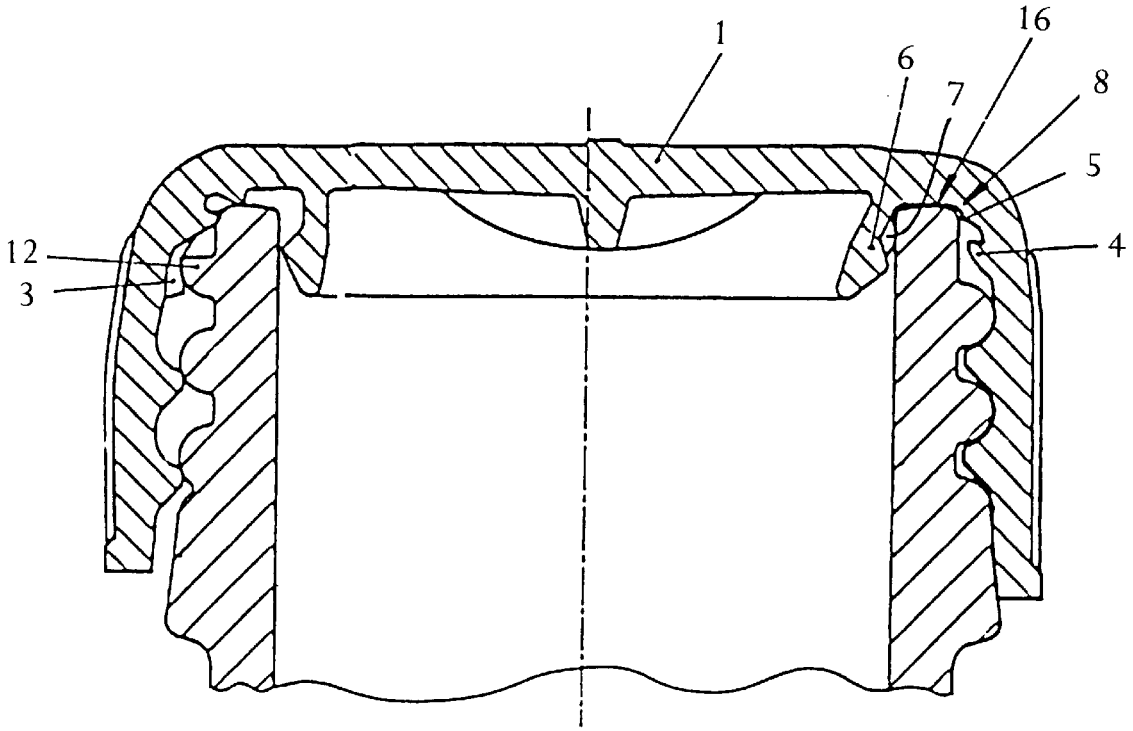
Figure 6:
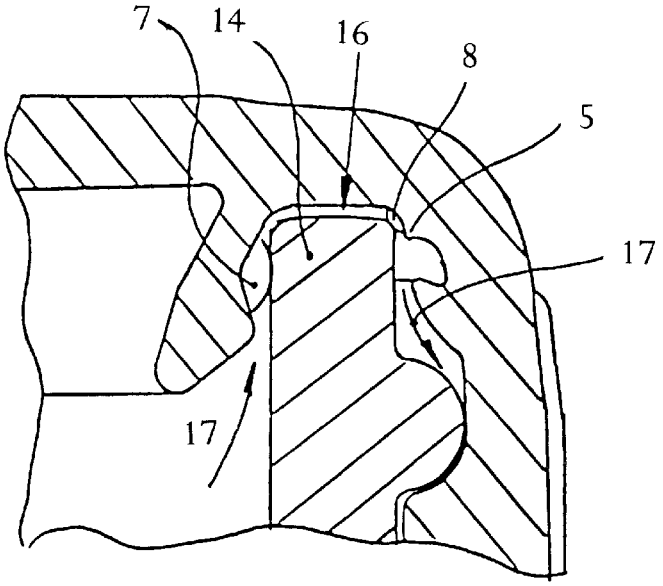
Figure 7:
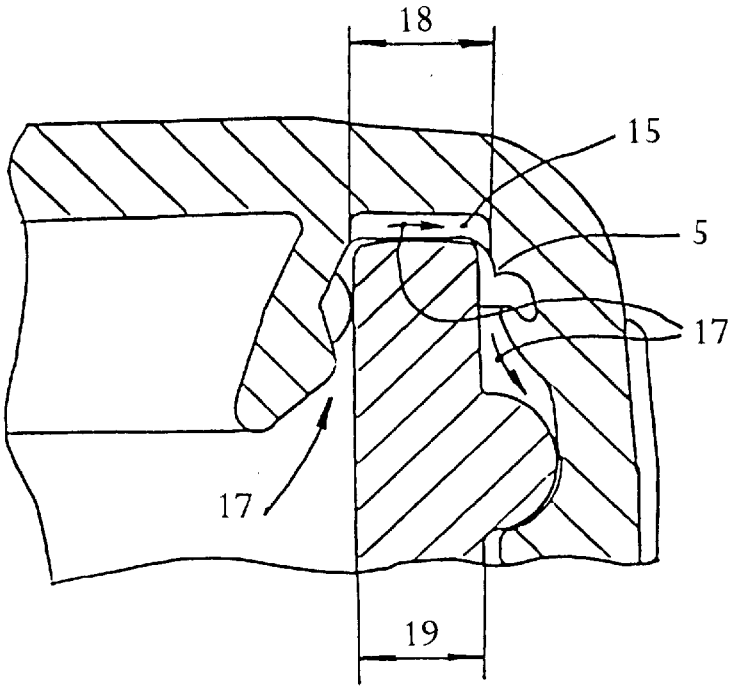
Figure 8:
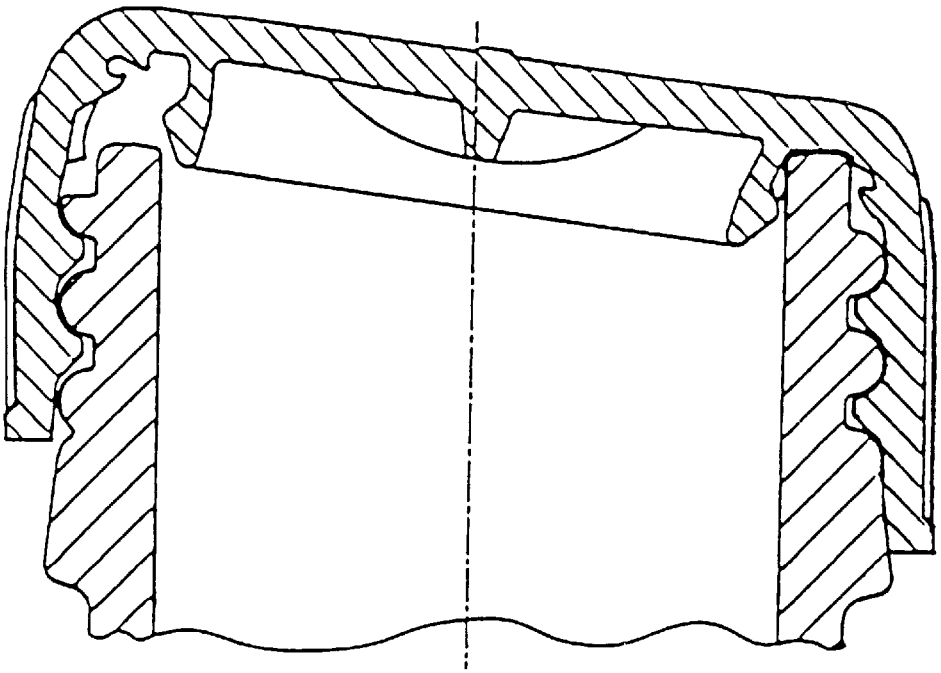

The invention is more closely explained on the basis of the following examples:

FIG. 1 a cross section through a closure-cap according to the plane 20—20 in FIG. 2, FIG. 2 a view of the inner side of a closure-cap, FIG. 3 a sectional drawing of a container mouth with a closure-cap screwed in place, FIG. 4 a sectional drawing of the container mouth according to FIG. 3, with a closure-cap which has been over-tightened through 45°, FIG. 5 a sectional drawing of the container mouth according to FIG. 3, with a closure-cap which has been over-tightened through 90°, FIG. 6 an enlarged drawing of the sealing region of the arrangement according to FIG. 5, on the side opposite the ramp element, FIG. 7 the sealing region, on the side opposite the ramp-element, of a closure-cap which has been over-tightened through 90°, and FIG. 8 an arrangement according to FIG. 5 after jumping of the closure-cap.

FIG. 1 shows a sectional drawing of a closure-cap along the plane 20—20 shown in FIG. 2. The cap comprises a cap-base 1 and a cap-wall 2 ajoining it. In order to seal the container mouth, the cap possesses three seals: an external-seal 4, a head-seal 5 taking effect on the facing surface, and an internal-seal 6. A ramp element is arranged on the inside surface of the cap-wall on the side of the internal thread which is oriented towards the cap-base. Distance elements 7, 8 are arranged in the region of the seal on the side of the closure-cap opposite the ramp element, said distance elements serving as retention elements.

FIG. 2 shows the view of the inside of a closure-cap. The ramp element has the form of an annular sector which extends over a sector $\alpha$ of 60° of the closure-cap. This ramp element is arranged directly beyond the thread-end 11 and toward the cap-base in the direction of the internal thread path. When the closure-cap is in the screwed on position, the container thread-start will be engaged with the thread-end 11. It will thus be positioned immediately in front of the ramp element 3. If the closure-cap is subjected to over-tightening, the ramp element will come into engagement with the container mouth thread-start. A plurality of distance elements 7, 8 are arranged on the side opposite the ramp element, distributed over a sector $\beta$ of 60° of the closure-cap. The inside thread possesses a plurality of venting-slots 9 running approximately parallel to the axis of the cap. These venting-slots enable an easy flow of gas during venting of the container when the seal is opened.

FIG. 3 shows a cross-sectional drawing of a container mouth with the cap in the mounted position. The three sealing-lips 4, 5, 6 lie circumferentially against and hermetically seal the container mouth.

FIG. 4 shows a cross section of the container mouth according to FIG. 3, with a closure-cap which has been over-tightened through 45°. The ramp element 3 has, with that, run up onto the thread-start 12 of the container mouth. The cap-wall 2 is thus pressed away from the outside surface of the container mouth in the region of the ramp element 3, so that the inside thread is at this point less tightly engaged with the container thread. Jumping of the thread is therefore facilitated in the region of the ramp element. On the opposite side of the closure-cap, oriented away from the ramp element, the cap-wall will be pulled with correspondingly greater force against the container wall. The inside thread will thus be tightly engaged with the outside thread of the container. By means of the screw effect of the thread, in the event of over-tightening the cap-wall will be pulled downwards onto the container with a greater force in this region of the closure-cap. A deformation of the seal region will be the result, taking effect particularly on the side oriented towards the ramp element. With that, the external-seal 4 will be lifted away from the outer surface of the container mouth, and the sealing-line of the head-seal 5 will be displaced to the outer edge of the facing surface 16 of the container mouth. The cap-base 1 will also be displaced to the side oriented away from the ramp element, and this will lead to an inclination of the internal-seal on this side. At the same time, the distance elements 7 will be brought into a position nearer to the inside surface of the container mouth 13.

FIG. 5 shows a cross-sectional drawing of the container mouth according to FIG. 3, with a closure-cap which has been subjected to over-tightening through 90°. In comparison with FIG. 4, which shows the same closure arrangement but only subjected to 45° over-tightening, a clearly more extreme distortion of the seal region, in particular on the side opposite the ramp element, can be detected. The sealing-lip of the head-seal 5 has been dragged out over the outer edge of the facing surface of the container mouth. It does not make contact with the container in this region. Instead, the distance elements 8 now lie against the outer edge of the facing surface of the container mouth, and thus effectively prevent a seal from forming in this region of the container mouth. The cap-base, when compared with the condition shown in FIG. 4, has been displaced further towards the side oriented away from the ramp element. The inclination of the internal seal has been increased as a result, so that the distance element 7 now rests against the container mouth inner surface. The actual sealing-zone of the internal-seal 6 will thus be pressed away from the inner surface of the container mouth in the region of the distance elements 7. The sealing-line of the internal-seal is thus interrupted, and the distance elements 7 will prevent a seal being formed in the region of the internal-seal. In principle, for venting of the container it will then be sufficient to ensure that no surrounding sealing-line exists. The embodiment shown in this example has a special advantage in that all sealing-lines in the same circumferential region, namely on the side opposite the ramp element, will be interrupted. As result, a particularly direct venting-channel will arise.

FIG. 6 shows an enlarged drawing of the sealing region of the arrangement according to FIG. 5, on the side opposite the ramp element. The closure-cap only makes contact with the container mouth 14 in the region of the distance elements 7, 8. The gas within the container can therefore escape as suggested by the arrows 17. The distance element 8 takes effect both axially and radially and thus prevents both the formation of a seal in the region of the facing surface 16 of the container mouth and the formation of a seal against the outside surface of the container mouth by the displaced sealing-lip of the head-seal 5.

FIG. 7 shows the region of the seal on the side opposite to the ramp element, in the case of a closure-cap which has been subjected to over-tightening through 90°. This venting-slot is commences adjacent to the sealing-lip of the head-seal 5. Its length 18 is, at least when the region of the seal is subjected to deformation, greater than the thickness 19 of the wall the container mouth, so that it prevents the formation of a seal in the area of the facing surface of the container mouth.

FIG. 8 shows an arrangement according to FIG. 5 after jumping of the closure-cap 5. This will occur in the case of over-tightening through an angle of approximately 90°. With that, the thread will jump on one side, namely on the ramp element side, while remaining firmly engaged on the opposite side. This tendency can also be seen in FIGS. 4 and 5. In this way, with raised internal pressure in the container, re-engagement of the inside thread after thread-jumping can be achieved, with the closure-cap subsequently remaining on the container. In fact, no increased internal pressure will prevail at the moment of thread jumping, since this will have already been previously vented in accordance with the embodiments relating to FIGS. 5 to 7.

Inasmuch as the invention is subject to modifications and variations, the foregoing description and accompanying drawings should not be regarded as limiting the invention, which is defined by the following claims and various combinations thereof:

We claim:

1. Screwable, plastic closure-cap with a cap-base and an adjoining, cylindrical cap-wall, said cap-wall comprising an inside thread with a thread end directed toward the cap base for closure of a container mouth, said container mouth possessing an outside thread with a thread start;

said cap-wall further comprising sealing means to sealingly engage and form a seal line with the container mouth, said cap-wall further comprising a ramp element which is arranged on the end of the inside thread oriented towards the cap-base and outside the area of the thread in use when the closure-cap is in the screwed-on position, such that, in the case of over-tightening of the closure-cap, the ramp element is brought into engagement with the thread-start of the container mouth, forcing the cap wall outwardly and altering the seal line, thereby causing a deformation of the closure-cap and disengaging the sealing means from the container mouth in order to enable venting of the container.

2. The closure cap according to claim 1, characterized in and that in the region of the seal line at least one retention element is provided for prevention of the formation of a seal in the case of an altered course of the seal-line.

3. The closure cap according to claim 2, characterized in that said at least one retention element is arranged on a side of the closure-cap opposite the ramp element.

4. The closure cap according to claim 2, characterized in that said at least one retention element is a distance element for displacing a portion of the closure-cap away from the container mouth.

5. The closure cap according to claim 2, characterized in that at least one retention element is a venting-slot.

6. The closure cap according to claim 2, wherein said sealing means comprises a head-seal extending from the inside surface of the cap-base in order to seal the container mouth on its facing surface, and wherein on the side of the closure-cap opposite the ramp element at least one retention element is arranged next to and on the inner side of said head-seal.

7. The closure cap according to claim 2, said seal means comprising an internal seal extending from the inner surface of the cap base, and possessing at least one retention element on its outside surface circumferentially spaced approximately 180° away from the ramp element.

8. The closure cap according to claim 2, wherein said at least one retention element comprises a plurality of retention elements, said plurality of retention elements arranged to be distributed over a sector ($\beta$) of at least 20° of the closure cap.

9. The closure cap according to claim 8, characterized in that the retention elements are arranged to be distributed over a sector ($\beta$) of approximately 60° of the closure-cap.

10. The closure cap according to claim 1, characterized in that the ramp element extends over a sector ($\alpha$) of at least 20° of the closure-cap.

11. The closure cap according to claim 1, characterized in that the ramp element is arranged directly beyond the thread-end.

12. The closure cap according to claim 1, characterized in that the closure cap has a vertically extending axis and the inside thread possesses venting-slots running approximately parallel to the axis of the cap.

13. A screwable, plastic closure-cap with a cap-base and an adjoining, cylindrical cap-wall, said cap-wall comprising an inside thread with a thread end directed toward the cap base for closure of a container mouth, said container mouth possessing an outside thread with a thread start;

said cap-wall further comprising sealing means to sealingly engage and form a seal line with the container mouth, said cap-wall further comprising a ramp element which is arranged on the end of the inside thread oriented towards the cap-base and outside the area of the thread in use when the closure-cap is in the screwed-on position, said cap-wall further comprising at least one retention element that is arranged on a side of the closure cap opposite to the ramp element, such that, in the case of over-tightening of the closure-cap, the ramp element is brought into engagement with the thread-start of the container mouth and the retention element is brought nearer to an inside surface of the container mouth, forcing the cap wall outwardly and altering the seal line, thereby causing a deformation of the closure-cap and disengaging the sealing means from the container mouth in order to enable venting of the container.

* * * * *

UNITED STATES PATENT AND TRADEMARK OFFICE

CERTIFICATE OF CORRECTION

PATENT NO. : 5,871,111

DATED : February 16, 1999

INVENTOR(S) : Pfefferkorn, et al

It is certified that error appears in the above-identified patent and that said Letters Patent is hereby corrected as shown below:

On the title page, item [30], delete "289/94" and insert --289/94-8--therefor.

delete "9206634 U" and insert --9206634-8 U-- therefor.

delete "9208944 U" and insert -- 9208944-5 U-- therefor.

Column 1, Line 6, delete "are manufacture by" and insert --are manufactured by-- therefor.

Column 1, Line 40, delete "is its fully" and insert --is at its fully-- therefor.

Column 1, Line 55, delete "threadend." and insert --thread-end.-- therefor.

Column 3, Line 27, delete "ramp element=a most" and insert --ramp element-a most-- therefor.

Column 4, Line 30, delete "A more rapid opening if the" and insert --A more rapid opening of the-- therefor.

Column 4, Line 38, delete "closurecap" and insert --closure-cap-- therefor.

Column 4, Line 56, delete "considerable thinner," and insert -- considerably thinner, -- therefor.

UNITED STATES PATENT AND TRADEMARK OFFICE

CERTIFICATE OF CORRECTION

PATENT NO. :5,871,111

DATED :February 16, 1999

INVENTOR(S) :Pfefferkorn, et al

It is certified that error appears in the above-identified patent and that said Letters Patent is hereby corrected as shown below:

Column 6, Line 67, delete "slot is commences" and insert --slot 15 commences-- therefor.
Column 7, Line 47, delete "formation of a seal" and insert --formation of a seal line-- therefor.

Signed and Sealed this

Seventeenth Day of August, 1999

*Attest:*

Q. TODD DICKINSON

*Attesting Officer*

*Acting Commissioner of Patents and Trademarks*